US006032288A

United States Patent [19]

Simone

[11] Patent Number: 6,032,288

[45] Date of Patent: Mar. 7, 2000

[54] COMBINATION ROBE AND GOWN

[76] Inventor: Jennifer Simone, 1 Westview Ter., Poughkeepsie, N.Y. 12603

[21] Appl. No.: 09/127,931

[22] Filed: Aug. 3, 1998

[51] Int. Cl.[7] ..... A41D 13/12; A41D 13/00; A41D 10/00

[52] U.S. Cl. ..... 2/69; 2/114

[58] Field of Search ..... 2/69, 105, 114, 2/720, 794, 797, 739, 760, 756, 823, 828, 807, 759, 801, 830, 861, 862, 854, 853, 841

[56] References Cited

U.S. PATENT DOCUMENTS

| | | | |
|---|---|---|---|
| 2,686,914 | 8/1954 | Weiser | 2/114 |
| 2,768,383 | 10/1956 | De Witt | 2/114 |
| 3,129,432 | 4/1964 | Belkin | 2/114 |
| 3,349,409 | 10/1967 | Hall | 2/74 |
| 3,359,569 | 12/1967 | Rotanz et al. | 2/114 |
| 4,434,511 | 3/1984 | Weiser | 2/114 |
| 4,494,248 | 1/1985 | Holder | 2/69 |
| 5,440,763 | 8/1995 | Shah et al. | 2/114 |
| 5,444,872 | 8/1995 | Johnson | 2/114 |

*Primary Examiner*—John J. Calvert
*Assistant Examiner*—Alissa L. Hoey
*Attorney, Agent, or Firm*—Joseph B. Taphorn

[57] ABSTRACT

A garment combines a hospital gown with a robe. The gown extends across the front of and around and partially behind a patient. It is attached on one side end to the inside of a side of the robe and on that side's top to the shoulder of the robe. The other or free side end of the gown is folded on itself so that the tops of its behind and corresponding front portions may be sewn together to form a shoulder support. The top of the gown around portion is cut away to form an arm hole. The robe is made of three panel pieces: a back panel with lateral extensions and central collar part at its top; and right and left side panels each formed at the top with a lateral extension and a collar part. The top and bottom edges of corresponding lateral extensions are sewn together; likewise the adjacent edges of the side panels and the back panel above the sleeves, to the gown and robe collars, and the adjacent edges below the sleeves, to the bottom of the gown and robe. Cooperating VELCRO fastening elements on the outside of the gown's free-side shoulder and on the inside of the corresponding robe shoulder, may be used to hold the garment in place and with the robe closed.

19 Claims, 2 Drawing Sheets

COMBINATION ROBE AND GOWN

INTRODUCTION

1. Field of the Invention

This invention relates to clothing, and more particularly to a garment which advantageously combines a gown such as a hospital gown, with a robe.

2. Background of the Invention

Particulary in hospitals, patients wear hospital gowns split down the back to provide an easy opening for physical access to the patient's body, easy dressing and undressing of the patient, and easy patient use of toilet facilities. The gown is supported on the shoulders of the wearer, and contains arm holes about which short sleeves may be attached exteriorly and the wearer's arm extended on dressing. Such a gown is fine when use is confined to a hospital bed, and perhaps to hospital room.

Patients however, do get out of bed to use the toilet facilities, to receive visitors and to exercise, the latter two involving a trip out of the room and down the public hall and perhaps into a public reception area. These "public" exposures cause a patient if only the gown is worn, to be uncomfortable from worrying because his or her sense of modesty is impacted by the back split in the gown or because of gown's appearance in general, and from cold due to not wearing additional clothing which hospitals discourage retention of in the hospital. Accordingly, patients today tend to stay in their bed rather than exercise, and to receive visitors in their room where they disturb other patients in the room rather than in the reception area.

3. Prior Art

Prior art in hospital gowns includes U.S. Pat. No. 4,622,699 issued to Spriggs; U.S. Pat. No. 5,133,086 issued to Truitt et al; and U.S. Pat. No. 5,444,872 issued to Johnson. Spriggs helps the patient retain a sense of modesty by providing a hospital gown with overlapping panels which are secured by inside and outside ties. Tuitt et al disclose a hospital gown that has various openable seams to provide access to different body portions. Johnson discloses a hospital gown having front and back seams with overlapping panels.

SUMMARY OF THE INVENTION

Accordingly it is an object of the invention to improve the comfort of patients in a hospital.

Another object of the invention to improve the comfort of the patient without significantly impacting access by the doctor, nurse, and other medical personnel.

A further object of the invention is to provide a garment which provides all of the functions, features, and advantages that a hospital gown does while disturbing a patient's sense of modesty less.

Still another object of the invention is to provide a garment which provides all of the functions, features, and advantages that a hospital gown does while keeping a patient warmer both in and out of the hospital bed.

Yet another objecer of the invention is to provide a garment which provides all of the functions, features, and advantages that a hospital gown does while disturbing a patient's sense of modesty less and keeping a patient warmer both in and out of the hospital bed.

A yet further object of the invention is to provide a garment which provides all of the functions, features, and advantages that a hospital gown does while disturbing a patient's sense of modesty less and keeping a patient warmer both in and out of the hospital bed, and easy of dressing and undressing, convenient to wear, and readily maintained.

A still further object of the invention is to provide a garment which provides all of the functions, features, and advantages that a hospital gown does while disturbing a patient's sense of modesty less and keeping a patient warmer both in and out of the hospital bed, and that is simple of construction and inexpensive of manufacture.

The objects of the invention are achieved through a simple two part garment. To the inside of one side of a robe, the edge on one side of a partially wrap-around gown is attached. The gown is intended to be wrapped around the front and part of the rear of the patient's body so that the essential modesty of the patient is preserved. Ready medical-personnel access to the the patient's body while maintaining the gown in front of the patient's body, is enabled by fixing the top edge of the gown portion worn in the rear of the patient to the top edge of the corresponding gown portion worn in the front of the patient and cutting an arm hole opening in the top of the gown at the fold between these rear and front gown portions. Thus the patient inserts his free arm through the gown fold arm hole on donning the garment to support the gown on his second shoulder, the gown and the robe being supported too on the other shoulder upon inserting the first arm through an arm hole in the side of the robe to which the edge of the gown is attached. Thereafter the free arm would be inserted into the second arm opening in the robe, and the two-part garment secured in place on the wearer by coacting fasteners on the gown and robe above the second shoulder.

Ready access of the medical personnel to the patient's body would be enabled by simply loosening the shoulder fasteners, removing the free arm from the second arm opening of the robe, and swinging the portion of the robe bearing the second arm opening backwards and around patient to expose the patient's back. If complete patient exposure is necessary, the second arm would simply be withdrawn from the gown arm hole and the freed gown swung around the patients front, with or without the robe being removed from the patients first arm.

BRIEF DESCRIPTION OF THE DRAWING OF A PREFERRED EMBODIMENT

These and other objects, features, and advantageous of the invention will become apparent from a reading of the following detailed description, when considered with the attached drawings wherein:

FIG. 1 is a diagrammatic front view of an opened robe/closed hospital gown constructed according to the invention; and FIG. 2 is a diagrammatic front view of a portion of a closed robe/closed hospital gown constructed according to the invention.

DETAILED DESCRIPTION OF A PREFERRED EMBODIMENT OF THE INVENTION

Figure 1:
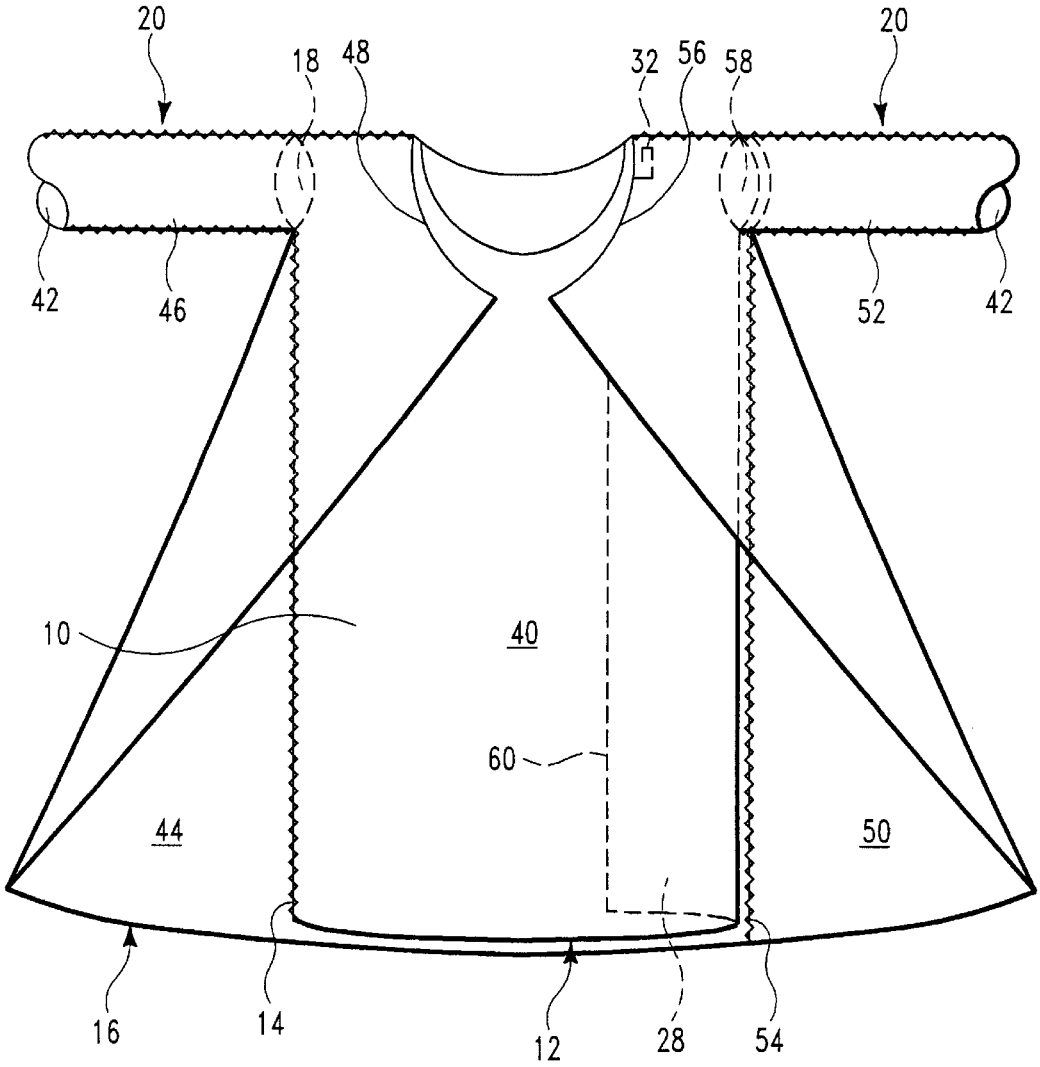

Referring now more particularly to FIG. 1 of the drawing, the new garment is shown as being economically achieved by sewing the right-hand (as worn by the patient) vertical edge 10 of the front of a three-fifths (3/5) or so hospital gown generally indicated by the numeral 12, to the inside at a seam 14 of the right side of a robe generally indicated by the numeral 16. The gown edge 10 is generally in line with the right-hand arm hole opening 18 for one of the sleeves generally indicated by the numeral 20 of the robe 16, not being sewn at that opening and accommodating insertion behind the gown of the patient's right-hand arm into the robe sleeve 20.

The robe 16 may be formed of three panels of cloth. A central, generally rectangular panel 40 constituting the back of the robe, is formed at its upper end on the sides with lateral extensions 44 for forming the back sides of the sleeves 20 and on the center with a recession for a collar. A right-hand (patient's) generally-rectangular panel 44 (shown unfolded outward at its bottom edge and folded inward at its upper edge), is formed at its upper end on the rearward side with a lateral extension 46. It is secured, as by sewing, at its back vertical edge below the lateral extension 46, to the panel 40 at the seam 14.

The lateral extension 46 is secured, as by sewing, at its top and bottom edges to the top and bottom edges of the right lateral extension 42 of the central panel 40, to form the right hand sleeve 20 of the robe 12. The sewing of the upper extension edges is continued across the top of the panel 44 and the top of the panel 40, to where a neck-fitting curved edge or collar 48, formed by removing a somewhat quarter-round portion from the upper corner of the free end of the panel 44, obtains. The sewing of the top of the panel 44 and the top of the panel 40 serves to form a shoulder for supporting the patient's right hand portion of the robe 12 on him.

A left-hand (patient's) generally-rectangular panel 50 (shown unfolded outward at its bottom edge and unfolded inward at its upper edge and a mirror image of the right hand panel 44), is formed on the rearward side at its upper end with a lateral extension 52. It is secured at its back vertical edge below the lateral extension 52, to the panel 40 at the seam 54. The lateral extension 52 is secured, as by sewing, at its top and bottom edges to the top and bottom edges of the right lateral extension 42 of the central panel 40, to form the left-hand sleeve 20 of the robe 16.

The sewing of the upper extension edges is continued across the top of the panel 50 and the top of the panel 40, to where a neck-fitting curved edge or collar 56, formed by removing a quarter-round portion from the upper corner of the free end of the panel 44, obtains. The sewing of the top of the panel 50 and the top of the panel 40 serves to form the shoulder for supporting the left-hand portion of the robe 16 on the patient.

The gown 12 extends from its point of attachment, seam 14, to the inside of the right hand side of the robe 16, across the front of the patient and then partially around the patient's back. At a point opposite the left-hand sleeve 20, the upper edge of the around portion of the gown 12 is cut away at 58 to provide an opening for the passage of the patient's left arm through the gown and into the sleeve. The top edges of the gown to each side of the opening 58 are sewn together to the gown back edge 60 to form the shoulder for supporting the left-hand portion of the gown 12 on the patient.

Figure 2:
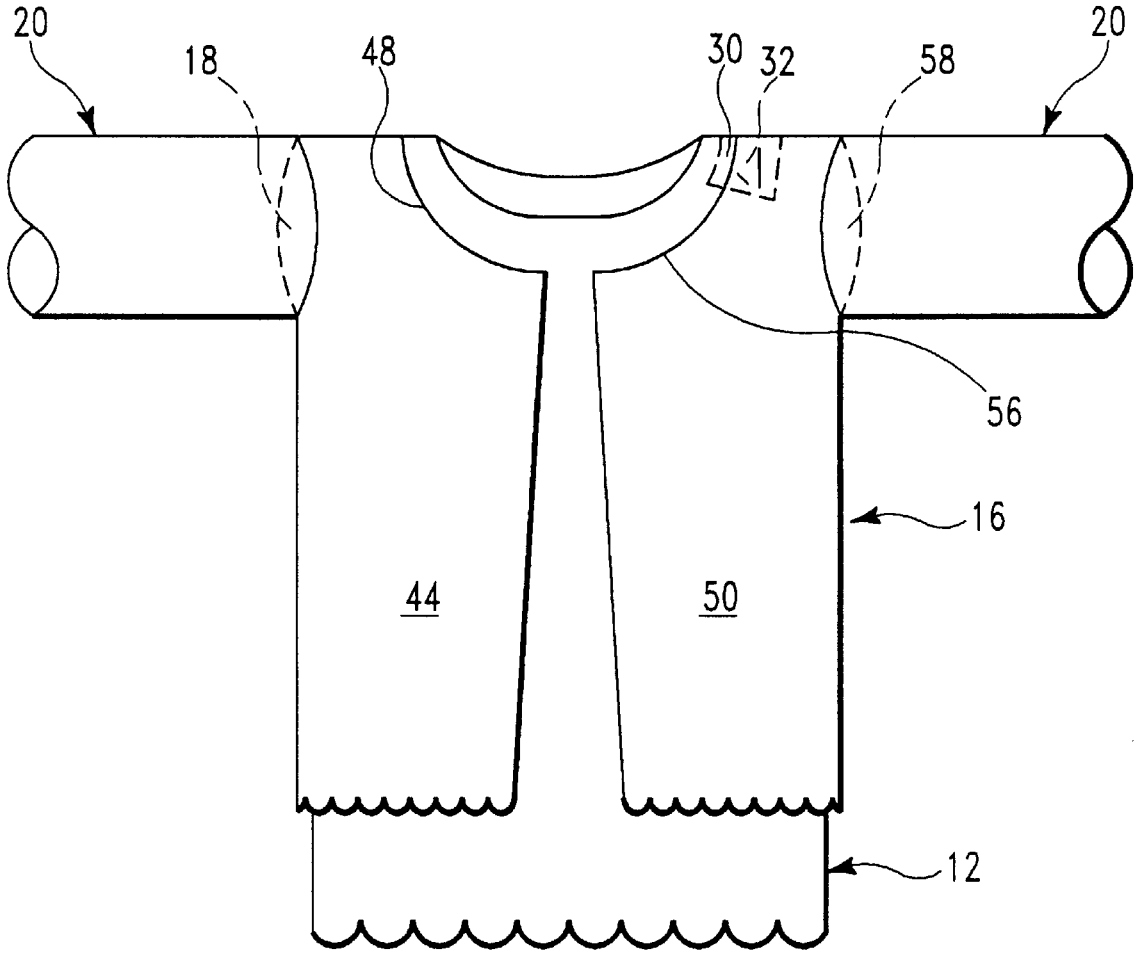

As shown in FIG. 2, the two-part robe and gown garment may be secured secured in place on the wearer by coacting fasteners on the gown and robe above the second shoulder. These fasteners may be VELCRO fastening element 30 secured on the top surface of the left-side shoulder of the gown 12 near its neckline, and a mating VELCRO element 32 secured on the bottom surface of the left-side shoulder of the robe 16. No fastening elements are needed on the right shoulder as gown 12 holds the robe panel 44 in place via the seam 14.

In dressing, the wearer would insert the right hand arm behind the gown 12 into the arm hole for the right hand sleeve 20 of the robe 16. The free end 28 of the gown would then be passed in front of the wearer to his or her left side and on around behind during which action the left arm would be passed through the gown sleeveless opening or arm hole 58 and into the arm hole for the robe left-hand sleeve 20. The robe 16, and hence the gown 12, would be secured in place about the wearer by pressing the left-shoulder VELCRO fastening elements 30 and 32 together.

When medical personnel wish to examine a patient's back, the patient's left arm, after separating the fastener elements 30 and 32, would be withdrawn from the corresponding robe sleeve 20 and the free portion of the robe swung behind the patient. The back would then be partially exposed; if more of the patient is to be examined, the gown could be swung around, with or without the left arm being withdrawn from the 58. The patient's body could be completely exposed by then withdrawing the patient's right hand arm from the sleeve of the robe.

In use as when preparing to utilize toilet facilities, the lower left hand side of the robe could be swept around backwards and the lower free end of the gown swept around forwards to expose the derriere beneath the robe. Upon completion of bodily functions, the free end of the gown would be swept around backwards and the robe lower left hand side allowed to swing forward and around to normal dress position.

While there has been shown and described a preferred embodiment of the invention, it will be apparent to those skilled in the art that other and different applications may be made of the principles of the invention. It is desired therefore to be limited only by the scope or spirit of the appended claims.

What is claimed is:

1. A garment comprising a robe opening in the front and an attached hospital gown that partially extends behind a wearer.

2. A garment according to claim 1, wherein the gown extends across the front of a wearer.

3. A garment comprising a robe and an attached hospital gown, wherein the gown extends across the front of a wearer, wherein the gown further extends around and partially behind a wearer.

4. A garment according to claim 3, wherein the gown has sides and is attached on one side to an inside of the robe.

5. A garment according to claim 4, wherein the gown is attached for a distance along the one side to the inside of the robe.

6. A garment according to claim 5, wherein the robe has arm holes and the gown is attached for a distance along the one side to the inside of the robe and below an arm hole.

7. A garment according to claim 6, wherein the gown is also attached to the robe for a distance between the arm hole and a collar of the robe.

8. A garment according to claim 3, wherein the gown has a top and the top of the portion of the gown extending behind a wearer is attached to the top of the corresponding portion extending across the front of wearer to form a support for that side of the gown.

9. A garment according to claim 8, wherein the portion of the gown extending around the wearer has an opening cut in its top to form an arm hole.

10. A garment according to claim 2, wherein the gown has sides and is attached on one side to the inside of the robe.

11. A garment according to claim 4, wherein the robe has arm holes and the gown is attached for a distance along the one side to the inside of the robe and below its corresponding arm hole.

12. A garment according to claim 10, wherein the robe has arm holes and the gown is attached for a distance along the one side to the inside of the robe and below its corresponding arm hole.

13. A garment according to claim 1, wherein the robe has a back portion and left and right side portions for folding around the front of a wearer, each portion having top and which side portion tops are secured to the top of the back portion to form shoulders.

14. A garment according to claim 13, wherein the robe back and left and right side portions are separate panels sectored together along a juncture of their side edges and formed at their top ends with lateral extensions secured together at their top and bottom edges to form sleeves.

15. A garment according to claim 14, wherein the gown is attached on one side for a distance along one of the junctures to the inside of the robe.

16. A garment according to claim 13, wherein the gown is attached to the robe at one of the shoulders.

17. A garment according to claim 16, wherein the gown is also attached to the robe at the shoulder above the one side of the gown.

18. A garment according to claim 17, wherein the robe left and right side portions have free sides and the gown has an other side, and coacting fasteners on the other shoulder of the robe and the other side of the gown for securing the robe on a wearer and so that the robe free sides tend to lie in place in front of the wearer.

19. A gown having portions including a free side portion for extending across the front and around and partially behind a wearer and a fixed side portion for attachment of its fixed side area for a distance along the side to the inside of a robe with a collar below an arm hole and attachment to the robe for a distance between the arm hole and the collar of the robe, each of said portions having tops, wherein the top of the portion of the gown for extending behind a wearer is attached to the top of the corresponding portion extending across the front of wearer to form a shoulder, and the portion of the gown extending around the wearer has an opening cut in its top to form an arm hole.

* * * * *